United States Patent [19]

Fujita

[11] 4,043,111

[45] Aug. 23, 1977

[54] INDICATED TIME-CORRECTING DEVICE OF DIGITAL DISPLAY TIMEPIECE

[75] Inventor: Minoru Fujita, Kodaira, Japan

[73] Assignee: Hitachi, Ltd., Japan

[21] Appl. No.: 621,559

[22] Filed: Oct. 10, 1975

[30] Foreign Application Priority Data

Oct. 18, 1974 Japan ..... 49-119356

[51] Int. Cl.[2] ..... G04C 3/00

[52] U.S. Cl. ..... 58/23 R; 58/85.5

[58] Field of Search ..... 58/23 R, 50 R, 85.5

[56] References Cited

U.S. PATENT DOCUMENTS

| | | | |
|---|---|---|---|
| 3,768,247 | 10/1973 | Fujita | 58/23 R |
| 3,810,356 | 5/1974 | Fujita | 58/23 R |
| 3,834,152 | 9/1974 | Nishimura et al. | 58/23 R |
| 3,852,951 | 12/1974 | Sauthier | 58/23 R |
| 3,852,952 | 12/1974 | Vittoz et al. | 58/23 R |
| 3,925,978 | 12/1975 | Naito | 58/23 R |
| 3,939,641 | 2/1976 | Nishimura et al. | 58/23 R |
| 3,943,696 | 3/1976 | Portmann et al. | 58/23 R |
| 3,949,546 | 4/1976 | Saito | 58/50 R |
| 3,978,649 | 9/1976 | Naito | 58/23 R |
| 3,994,124 | 11/1976 | Fujita | 58/23 R |
| 4,004,407 | 1/1977 | Fujita | 58/23 R |

*Primary Examiner*—Stanley J. Witkowski
*Attorney, Agent, or Firm*—Craig & Antonelli

[57] ABSTRACT

A time indication correcting device of a digital display timepiece, wherein upon depressing the time adjusting switch, a counter of the second digit (or the counter of the minute digit) is reset and is held in the reset state, and simultaneously therewith, the minute digit counter (or the hour digit counter) receives one pulse and is stopped after counting the pulse, and upon releasing the time adjusting switch at a predetermined time, the clock operation is started, whereby the indication of the minute digit (or the hour digit) can be corrected.

8 Claims, 4 Drawing Figures

INDICATED TIME-CORRECTING DEVICE OF DIGITAL DISPLAY TIMEPIECE

DETAILED DESCRIPTION OF THE INVENTION

This invention relates to an indicated time-correcting device of a timepiece as is constructed of an electronic circuit and as simply corrects the indicated time of the digital display timepiece.

Timepieces of the digital display type in which the time is indicated by numerals have recently come into use. In such a timepiece of the digital display type, a correcting device for bringing the indicated time into agreement with a predetermined time is provided with switches which adjust the second digit, the minute digit and the hour digit, respectively. In the case of adjusting the minute digit, a mechanism is used by which the minute digit is once reset (00 minute) or stopped; numerals are thereafter fed rapidly by quick drive means for signals, and the quick drive is stopped at the predetermined time. The correcting device is disclosed in, for example, Japanese Patent Application Publication No. 37862/1973.

The timepiece employing such correcting device has hitherto required a plurality of switches on the external surface of the timepiece, so that an incorrect operation is prone to occur and that an inexperienced person fumbles. When the quick drive means feeds the numerals too rapidly, it is difficult to set the predetermined time, whereas when the rapid feed is slow, the time adjustment takes a long time.

In practical use, an error arising in the timepiece of the electronic digital display type is slight at any time other than the case of the replacement of a battery and the case of the initiation of starting, and it amounts to 1–2 minutes or so. With the correcting device as in the prior art, accordingly, the number of the switches on the external surface of the timepiece is uselessly large, which leads to the disadvantages of a troublesome operation and a time consuming adjustment.

An object of this invention is to provide an indicated time-correcting device of a digital display timepiece as eliminates the above disadvantages to allow a simple operation in practical use and to allow an adjustment in a short time and as does not require many switches for the adjustment.

The correcting device according to this invention corrects the time in such way that, upon depressing a time adjusting switch, the second counter is held in the reset state, while one pulse is sent to the minute counter to stop it, and that, upon releasing the time adjusting switch at a predetermined time, the clock operation is initiated. Accordingly, the time correction becomes possible by the depression of the time adjusting switch and can be made simply and in a short time.

Hereunder this invention will be described in detail in conjunction with an embodiment.

Figure 1:
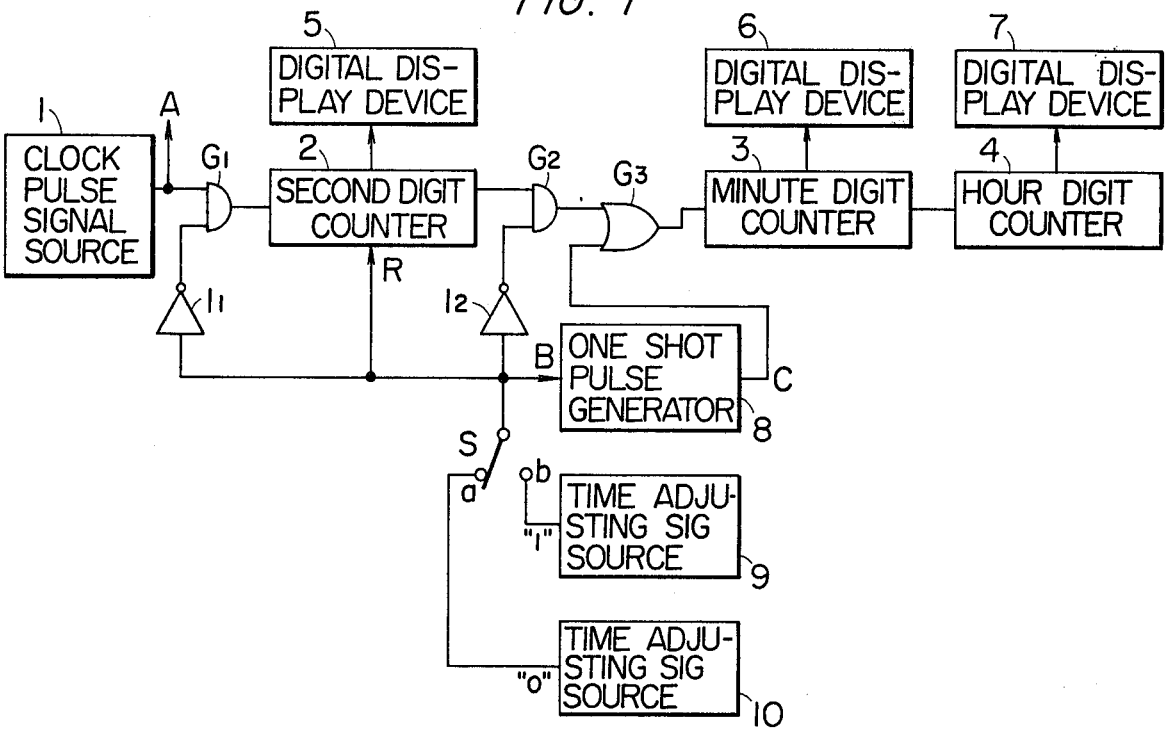
FIG. 1 shows a system block diagram of an electronic timepiece which employs a time correcting device according to the present invention.

The drawing figures illustrate an embodiment according to this invention. In FIG. 1, numeral 1 designates a clock pulse signal source which normally delivers output pulses of the logical level 1 at a predetermined period, for example, at 1 Hz in order to perform the clock operation. Numeral 2 denotes a sexagesimal counter which counts the second digit, numeral 3 a sexagesimal counter which counts the minute digit, and numeral 4 a duodecimal or quarterbicinary counter which counts the hour digit. Numerals 5, 6 and 7 denote display devices which serve to digitally indicate the second digit, the minute digit and the hour digit in conformity with the count state of the respective counters. As these counters and display devices, there can be employed, for example, those contained in U.S. Pat. No. 3,714,867.

Figure 2:
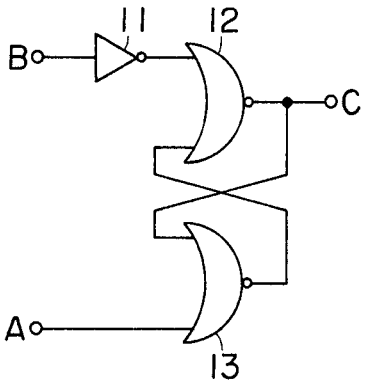
FIG. 2 shows an example of one shot pulse generator 8 in FIG. 1.
Figure 3:
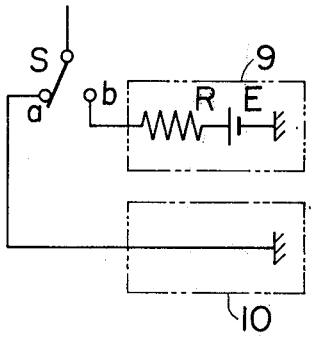
FIG. 3 shows an example of time adjusting signal sources 9 and 10 including switch S in FIG. 1.

Shown at 9 and 10 are time adjusting signal sources, which normally generate outputs of the logical levels 1 and 0, respectively as shown in FIG. 3. Letter S indicates a time adjusting switch. Time adjusting source 9 comprises a battery E and a resistor R. $G_1$ and $I_1$ designate an AND gate and an inverter, respectively, which constitute means for cutting off the clock signal and holding the second counter 2 in the reset state by control of the time adjusting switch S. $G_2$ and $I_2$ designate an AND gate and an inverter, respectively, which constitute a time stopping switch which cuts off a carry signal coming from the second counter 2 and stops the minute time by control of the time adjusting switch S. Shown at $G_3$ is an OR gate, which receives the carry signal from the second counter 2 or an output of one shot pulse generating circuit 8 and transmits the pulse to the minute counter 3. Numeral 8 designates the signal shot pulse generating circuit as shown in FIG. 2 which generates one pulse by control of the time adjusting switch S, and which is constructed of, for example, a monostable multivibrator. Time adjusting signal sources 9 and 10 are connected through the time adjusting switch S to the second counter reset holding means ($G_1$, $I_1$), the time stopping switch ($G_2$, $I_2$) and the single shot pulse generating circuit 8.

The one shot pulse generating circuit is constructed by a kind of flip-flop circuit as shown in FIG. 2, wherein two NOR gate circuits 12 and 13 are cross-coupled and receive two signals A and B, respectively from the clock pulse signal source 1 and from the time adjusting signal sources, as inputs thereof. Inverter 11 is provided to allow gate 12 to receive signals of the correct polarity while the output C of gate 12 serves as the output of pulse generator 8 as well as being the input to gate 13.

The input of the second counter 2 is connected through the AND gate $G_1$ to the clock signal source 1. The input of the minute counter 3 is connected through the AND gate $G_2$ and the OR gate $G_3$ to the output of the second counter 2, and is further connected through the OR gate $G_3$ to the output of the single shot pulse generating circuit 8. A reset terminal R of the second counter 2 is connected through the time adjusting switch S to the time adjusting signal sources 9 and 10. When the time adjusting switch S lies at a terminal *a* which is connected to the time adjusting signal source 10 of the normally 0 level, a signal of the level 1 is applied to one input terminal of each of the AND gates $G_1$ and $G_2$, and the respective gates are open. Accordingly, the clock signal is inputted to the second counter 2, and the carry signal of the second counter is inputted to the minute counter 3 at the rate of one pulse every sixty seconds, so that the normal clock operation is carried out.

When the time adjusting switch S is changed-over to a terminal *b* which is connected to the time adjusting signal source 9 normally outputting the level 1, the AND gate $G_1$ is closed, and simultaneously therewith, the signal of the level 1 is applied to the reset terminal R to bring the second counter into the reset state so that the second counter stops counting. The minute counter 3 stops counting as the AND gate $G_2$ is closed, and simultaneously therewith, it receives the output of the single shot pulse generating circuit 8 through the OR gate $G_3$ and it stops after counting the one pulse. That is, the minute counter 3 stops at a time which is obtained by adding one minute to the indicated time at the time when the time adjusting switch S is operated. When, at the predetermined time, the time adjusting switch S is changed-over back to the terminal *a*, the timepiece initiates the normal operation again. Thus, the correction of the time is completed. By putting the time adjusting switch into the push-button type, it is possible to usually keep it connected with the time adjusting signal source 10 and to connect it with the time adjusting signal source 9 only when the switching is made. In case of such construction, the time adjustment can be conducted by a method in which a push button is depressed and then released at the predetermined time. The adjustment of several minutes can also be simply conducted by repeatedly depressing the push button.

In the foregoing embodiment, only the device for correcting the minute digit has been explained. It is obvious that the adjustment of the hour digit can also be made simply and in a short time by providing similar mechanisms for the minute digit counter and the hour digit counter, respectively.

Figure 4:
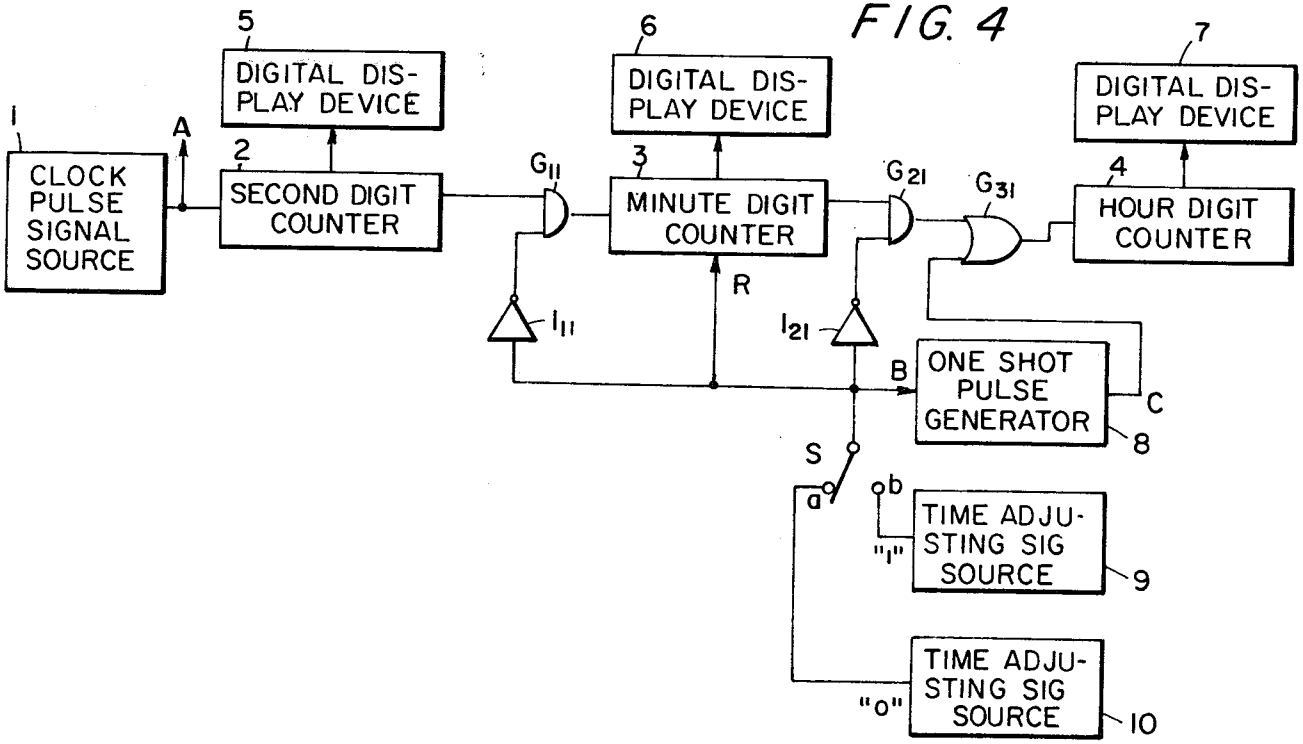
FIG. 4 illustrates the block diagram of another embodiment of the present invention.

FIG. 4 illustrates such an embodiment with gates $G_{11}$, $G_{21}$ and $G_{31}$ corresponding, respectively, to gates $G_1$, $G_2$ and $G_3$ of FIG. 1 while inverters $I_{11}$ and $I_{21}$ correspond respectively to inverters $I_1$ and $I_2$ of FIG. 1.

As stated above, this invention effects the adjustment of the time in such way that the second digit counter or the minute digit counter is reset and held in the reset state by the control of the time adjusting switch, that one pulse is simultaneously transmitted to and counted by the minute digit counter or the hour digit counter, and that the respective counters are thereafter stopped. Since the device can be operated extremely simply as the indicated time-correcting device of the digital display timepiece and can conduct the adjustment in a short time, it is greatly effective when applied to display timepieces such as a wrist watch or timer.

Although, in this invention, the counter has been explained as means for effecting the counting operation, it is apparent that the use of such counter as a shift register is also covered within the spirit of this invention, and a variety of alterations are possible.

What I claim is:

1. A digital display timepiece comprising a clock pulse signal source, counter means for counting the output pulses of said clock pulse signal source including a second counter, a minute counter and an hour counter connected in series, display means for digitally displaying the state of said counter means, and indicated time-correcting means for adjusting the state of said counter means including first means for disconnecting the output of said second counter from the input of said minute counter, second means for incrementing said minute counter, and selectively operable third means for simultaneously operating said first and second means.

2. A digital display timepiece comprising a clock pulse signal source, counter means for counting the output pulses of said clock pulse signal source including a second counter, a minute counter and an hour counter connected in series, display means for digitally displaying the state of said counter means, and indicated time-correcting means for adjusting the state of said counter means including first means for disconnecting the output of said minute counter from the input of said hour counter, second means for incrementing said hour counter, and selectively operable third means for simultaneously operating said first and second means.

3. In a digital display timepiece having a clock pulse signal source whose output signal is sequentially counted by respective counters of the second digit, minute digit, and the hour digit; said counters being connected in series with the count state of said respective counters being digitally indicated by display devices;

an indicated time-correcting device comprising first and second time adjusting signal sources respectively providing first and second time adjusting signals, first means controlled by said first time adjusting signal for inhibiting a carry signal outputted by said second counter and provided as an input for said minute counter and for holding said second counter in the reset state, second means responsive to said first time adjusting signal for transmitting one pulse to said minute counter, and a switch selectively connecting one of said two time adjusting signal sources to said first and second means, said second time adjusting signal source providing for normal clock operation.

4. A digital display timepiece according to claim 3, wherein said means for transmitting one pulse comprises a one shot pulse generator having as its inputs the output signal of said clock pulse signal source and the output of one of said first and second time adjusting signal sources.

5. A digital display timepiece as in claim 3, wherein said switch comprises a pushbutton type switch whereby depressing and releasing said pushbutton resets said second digit counter to its zero state and advances the state of the minute digit counter by one count.

6. In a digital display timepiece having a clock pulse signal source whose output signal is sequentially counted by respective counters of the second digit, minute digit, and the hour digit; said counters being connected in series with the count state of said respective counters being digitally indicated by display devices; signals, an indicated time-correcting device comprising first and second time adjusting signal sources, respectively providing first and second time adjusting signas, first means controlled by said first time adjusting signal for inhibiting a carry signal outputted by said minute counter and provided as an input for said hour counter and for holding said minute counter in the reset state, second means responsive to said first time adjusting signal for transmitting one pulse to said hour counter, and a switch selectively connecting one of said two time adjusting signal sources to said first and second means, said second time adjusting signal source providing for normal clock operation.

7. A digital display timepiece according to claim 6, wherein said means for transmitting one pulse comprises a one shot pulse generator having as its inputs the output signal of said clock pulse signal source and the output of one of said first and second time adjusting signal sources.

8. A digital display timepiece as in claim 6, wherein said switch comprises a pushbutton type switch whereby depressing and releasing said pushbutton resets said minute digit counter to its zero state and advances the state of the hour digit counter by one count.

* * * * *